US006745697B2

(12) United States Patent
Haak et al.

(10) Patent No.: US 6,745,697 B2
(45) Date of Patent: Jun. 8, 2004

(54) CARTRIDGE

(75) Inventors: Hans-Karl Haak, Unterlüss (DE); Alexei Voronov, Grosskrotzenburg (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/222,871

(22) Filed: Aug. 19, 2002

(65) Prior Publication Data

US 2003/0033953 A1 Feb. 20, 2003

(30) Foreign Application Priority Data

Aug. 18, 2001 (DE) ..... 101 40 599

(51) Int. Cl.[7] ..... F42B 5/08

(52) U.S. Cl. ..... 102/472; 102/430; 102/431; 102/467

(58) Field of Search ..... 102/202, 202.5, 102/202.7, 202.9, 430–433, 467, 472, 700

(56) References Cited

U.S. PATENT DOCUMENTS

| | | | | |
|---|---|---|---|---|
| 5,549,046 A | * | 8/1996 | Widner et al. | 102/202.7 |
| 5,945,623 A | * | 8/1999 | Goldstein et al. | 102/472 |
| 6,332,402 B1 | | 12/2001 | Weise et al. | |
| 6,332,403 B1 | | 12/2001 | Weise et al. | |
| 2002/0157559 A1 | * | 10/2002 | Brunet et al. | 102/472 |

FOREIGN PATENT DOCUMENTS

| | | |
|---|---|---|
| DE | 199 36 649 A1 | 11/2000 |
| DE | 199 36 650 A1 | 11/2000 |

* cited by examiner

*Primary Examiner*—Harold J. Tudor
(74) *Attorney, Agent, or Firm*—Venable LLP; Stuart I. Smith

(57) ABSTRACT

A cartridge with a propellant case (4) that contains a propellant charge (3) and an electrothermal ignition device, wherein several ignition channels (9) are provided in the charge (3), and extend axial-symmetrical in the direction of longitudinal axis (8) of cartridge (1), with each channel comprising a propellant tube (10) and an electrically conducting layer (11). To achieve a uniform and symmetrical ignition of the cartridge (1) in the chamber of the respective weapon, electric arcs (21) that form during the ignition operation in the ignition channels (9), are decoupled in that the electrically conducting layer (11) is composed of successively connected rhombi or other shapes (circles, ovals, etc.) that electrically function as decoupling resistances. When current flows through such a structure, the current bridges (20) arranged in the current-flow direction between the individual rhombi (15) etc. initially break apart explosively. Electric arcs (21) then are formed at these locations and are decoupled by the decoupling resistances (15). Continued current flow causes more and more of the decoupling elements (15) to erode, so that the electric arcs (21) become longer and longer.

10 Claims, 4 Drawing Sheets

CARTRIDGE

CROSS-REFERENCE TO THE APPLICATION

This application claims the priority of German Patent Application No. DE 101 40 599.5 filed Aug. 18, 2001, which is incorporated herein by reference.

BACKGROUND OF THE INVENTION

The invention relates to a cartridge with a combustible cartridge case containing a propellant charge and an electrothermal ignition device or igniter.

In order to ignite the propellant powder of known cartridges with an electrothermal ignition device, an extremely high current is allowed to flow through a wire conductor in the bottom region of the respective cartridge, which is high enough to cause an explosive vaporization, of the wire thus generating an energy-rich electric arc. The electric arc then ignites the respective propellant powder.

It has turned out to be a disadvantage of the known cartridge that only a relatively small percentage of the propellant powder is initially ignited when generating the electric arc on the bottom side. Frequently, this does not result in a reproducible burning behavior of the propellant charge, particularly with hard to ignite propellant powders, i.e., low vunerability ammunition (LOVA).

Also known is a cartridge with an ignition device that consists of several ignition channels, arranged axially symmetrical in a longitudinal direction of the cartridge. Each ignition channel comprises a propellant tube provided on its inside surface with an electrically conducting layer. If the respective conducting layer is connected to a power-supply system for igniting the charge, it is designed to vaporize abruptly and an electric arc plasma channel is created inside the respective propellant tube, through which current continues to flow. In the process, high-output energy is released to the environment in the form of radiation, thus resulting in a rapid ignition of the propellant tubes and the fragmentation of these tubes. The burning fragments of the propellant tubes, as well as the released electric arc radiation subsequently cause a quick and uniform ignition of the main propellant change.

However, practical experiments have shown that with this known cartridge, it is frequently not possible to produce several parallel electric arcs, despite electrically parallel-connected and axially symmetrical ignition channels. Rather, only one electric arc is initially ignited following the wire explosion, which then prevents the ignition of the additional, parallel electric arcs because of the drop in its current-voltage characteristic. As a result, asymmetrical, radial pressure waves develop, which can damage or destroy, for example, the projectile fin assembly and the weapon. To be sure, the ignition channels and thus also the electric arcs could be electrically separated and each ignition channel could be assigned a separate energy-supply system. However, this would result in an extremely expensive weapon system requiring a lot of space.

SUMMARY OF THE INVENTION

The object of the present invention is to provide a cartridge of the aforementioned type, for which a uniform and symmetrical ignition in the chamber of the respective weapon is possible, without requiring additional power-supply systems.

This object generally is achieved according to the present invention which is essentially based on the idea of decoupling the electric arcs by replacing the uniform, electrically conducting layer in each propellant tube with a conductive structure, consisting of successively point connected rhombi, rectangles, circles or ovals, which are arranged planar on the inside or outside of each powder tube and electrically assume the function of decoupling resistances. When current flows through a structure of this type, the connecting bridges arranged in the current-flow direction between the individual rhombi or other structures will first explode because of the ohmic overheating. Electric arcs then form at these locations, which are separated owing to the conductive structures with the resistive resistances. During the continued current flow, the decoupling elements erode even more, so that the electric arcs become longer and longer.

The exact geometry of the rhombi, such as width, length, thickness and material selection is based on the desired resistance values for the decoupling resistances.

The electrically conducting layer can be deposited directly onto the inside or outside surface of the respective propellant tube. However, it is also possible to provide a foil layer of a plastic over the inside or outside surface of the powder tube, onto which the electrically conducting layer can then be deposited. The foil can be a commercially available plastic foil, preferably consisting of polyester or polyethylene. The vapor-deposited structure preferably consists of aluminum or copper.

To ensure a secure and uniform ignition in each of the ignition channels, it has proven useful if an electrically conducting layer is vapor-deposited onto the inside or outside surface of the respective propellant tube. This layer comprises several, preferably three, parallel series connections of decoupling resistances that are joined together.

The length of the ignition channels can range from 50 to 400 mm and preferably ranges from 200 to 300 mm.

With another embodiment of the invention, for which the electrically conducting layer is arranged on the inside surface of the powder tube, an additional propellant tube or rod directly adjoins the conducting layer on the inside. As a result, the loading density of the cartridge can be increased even further.

Additional details and advantages of the invention follow from the exemplary embodiment below, which is explained with the aid of Figures.

DESCRIPTION OF THE PREFERRED EMBODIMENTS

Figure 1:
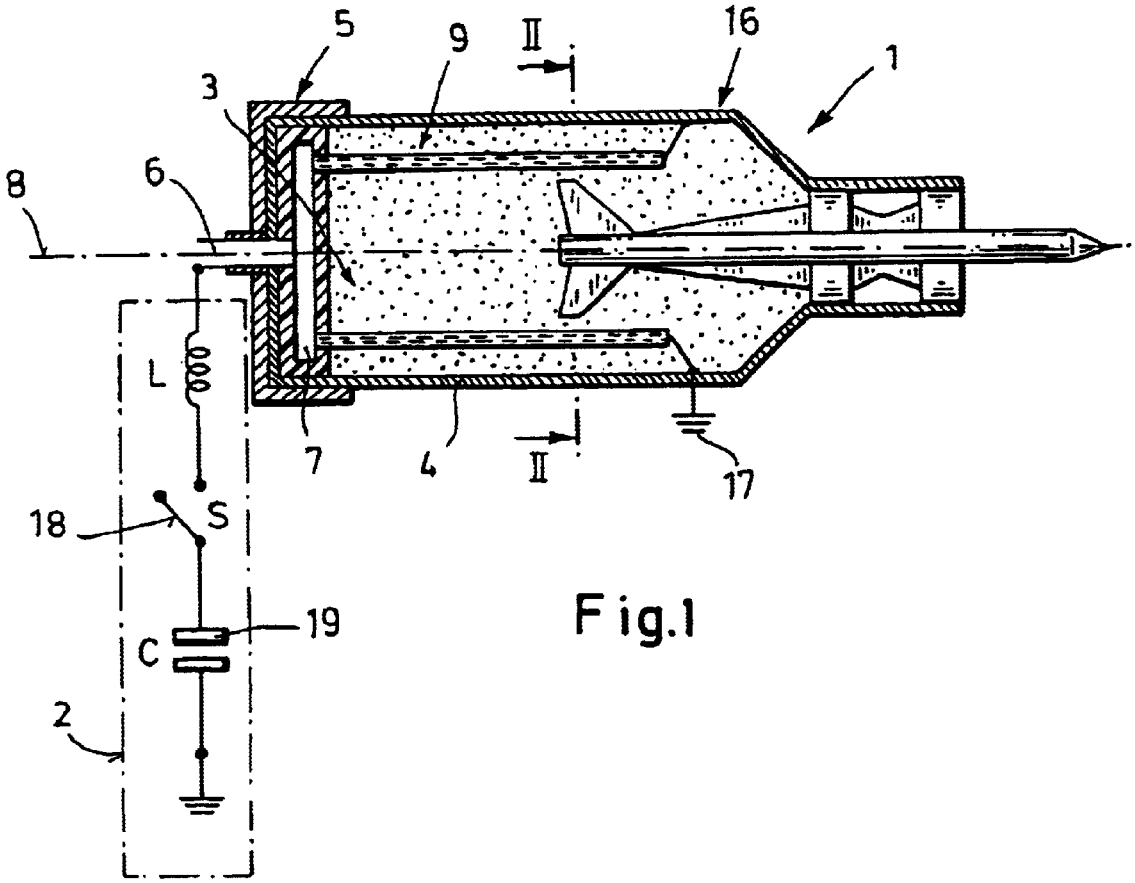
FIG. 1 is a longitudinal section through an exemplary embodiment of a schematically represented cartridge according to the invention, which has six ignition channels that are connected to a power-supply system.

Reference 1 in FIG. 1 refers to a large-caliber cartridge (e.g. to be fired from a tank weapon), which is connected to a power-supply system 2 for the ignition. The respective weapon in which the cartridge 1 is located is not shown for reasons of clarity.

The cartridge 1 comprises a case 4, consisting of a combustable material, that is filled with a propellant charge 3, as well as a case bottom 5 of metal that closes off the propellant case 4 on the bottom side.

A high-voltage electrode 6 is arranged in the center of case bottom 5, with the electrode 6 being insulated relative to the case bottom 5 and being connected to a metal disk 7 that functions as a current distributor and is disposed in the casing 4.

Figure 2:
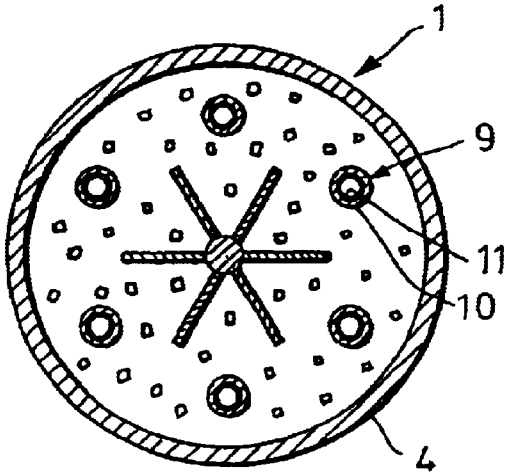
FIG. 2 is an enlarged cross section through the cartridge shown in FIG. 1, along the line II—II therein.
Figure 3:
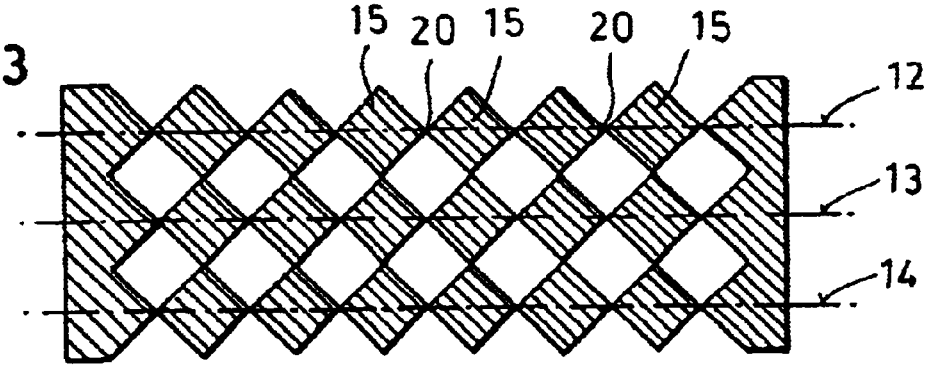
FIGS. 3–5 are schematic representations of an electrically conducting structure, arranged horizontally in the plane and consisting of three rows of rhombus-shaped regions, such as can be arranged in the ignition channel of the cartridge according to the invention. The structure is shown prior to the ignition operation in FIG. 3 and at two different points in time after the start of the ignition operation in FIGS. 4 and 5.

Six ignition channels 9 (FIG. 2) that respectively extend in the direction of longitudinal axis 8 of the cartridge 1 are arranged, preferably symmetrically, on the current distributor 7. Each of the ignition channels 9 comprises a propellant tube 10, provided on its inner surface with an electrically conducting layer 11 of metal, e.g., aluminum or copper, and preferably copper. This layer 11 is electrically connected to the metal disk 7 with its end or side facing the metal disk 7 and consists of preferably three series connections 12–14 of geometrically shaped regions 15, for example, rhombus or square-shaped regions as shown in (FIG. 3). The individual regions 15 are connected via connecting bridges 20, which may be effective point contacts between the respective regions or high resistance very narrow or small conductive connections. In the region of case lid 16 for the cartridge case 4, the electrically conducting layers 11 are connected to a ring-shaped contact 17, indicated only schematically in FIG. 1. Thus the series connections 12–14 all are electrically connected in parallel. The contact 17, in turn, makes contact with the inner wall of the weapon, not shown herein, which is connected to ground potential.

Figure 4:
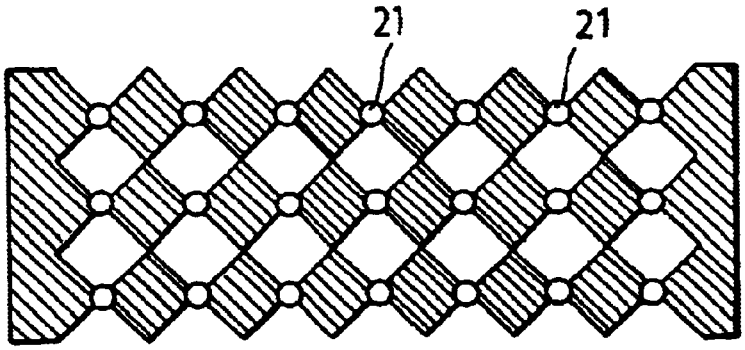
Figure 5:
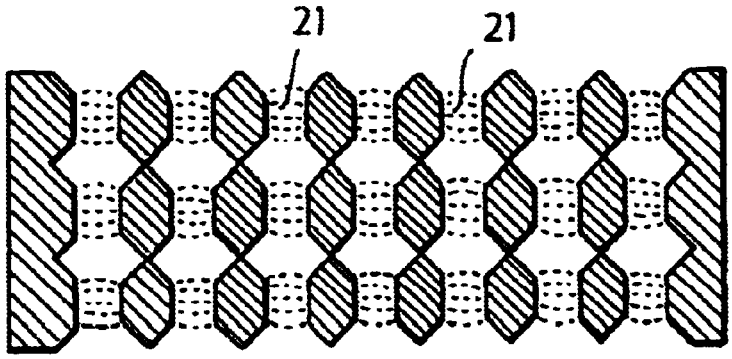

In order to fire the cartridge 1, a switch 18 in the power-supply system 2 is closed (FIG. 1) and a series of charged capacitors 19 in the power-supply system 2 are abruptly discharged, e.g., at a voltage of up to 40 kV. The discharge current that develops in the process leads to an electrical explosion of the connecting bridges 20 (FIG. 3) between the individual rhombi 15. Electric arcs 21 form at these locations (FIG. 4), which are separated from each other by the decoupling resistances 15, formed by the rhombus-shaped regions. If current continues to flow, more and more sections of the rhombus-shaped regions 15 erode, so that the electric arcs 21 become longer and longer (FIG. 5).

The propellant tubes 10 are ignited by the electric arcs 21 and are torn apart abruptly. The exploding, burning fragments of the powder tubes 10 as well as the released electric arc radiation subsequently cause a fast and uniform ignition of the propellant charge 3 inside the propellant case 4. This propellant charge 3 together with the combustible sections of the propellant case 4 are then fully burning.

Figure 6A:
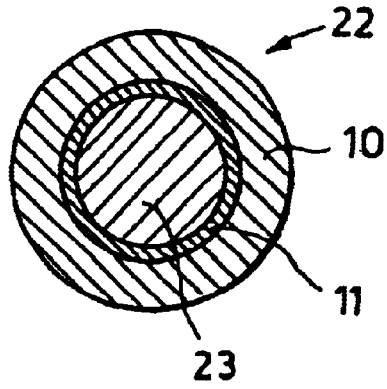
FIG. 6A is a cross section through an ignition channel with an electrically conducting layer arranged between a powder tube and a powder rod.

FIG. 6 shows another exemplary embodiment of the invention. For this embodiment, the ignition channel with reference number 22, together with the first propellant tube 10 with electrically conducting layer 11 on the inside (e.g., with rhombus-shaped structure), surrounds another propellant rod 23 that directly adjoins the layer 11 on the inside.

Figure 6B:
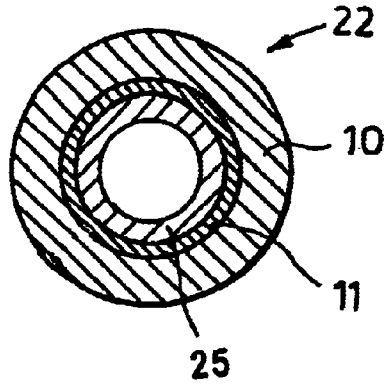
FIG. 6B is a cross section through an ignition channel with an electrically conducting layer arranged between a pair of powder tubes.

Of course, the invention is not limited to the aforementioned exemplary embodiments. For example, the propellant rod 23 for the exemplary embodiment shown in FIG. 6A can be replaced with an additional propellant tube 25 as shown in FIG. 6B. Also, it is not necessary to have six ignition channels. Three ignition channels that are arranged symmetrical in the chamber are sufficient, for example, for small calibers.

Figure 10:
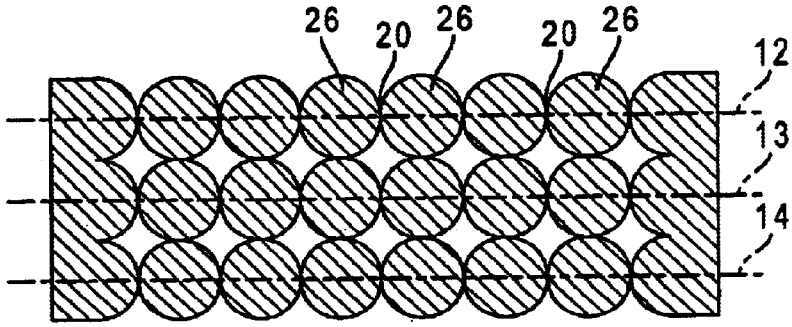
FIGS. 10 and 11 are figures similar to FIG. 3, but showing circular and oval regions instead of the rhombus, square or rectangular region of FIG. 3.
Figure 11:
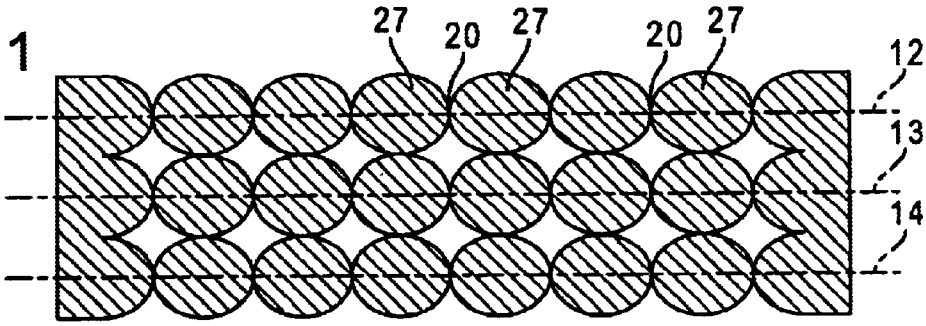

Furthermore, the electrically conducting regions 15 that define the decoupling resistances must not necessarily be rhombus-shaped. Other polygonal shapes or even a round geometry, e.g. a circle 26 as shown in FIG. 10, an oval as shown in FIG. 11, etc are conceivable, provided conducting bridges exist between these regions, which will then break apart explosively during a corresponding current flow.

Figure 7:
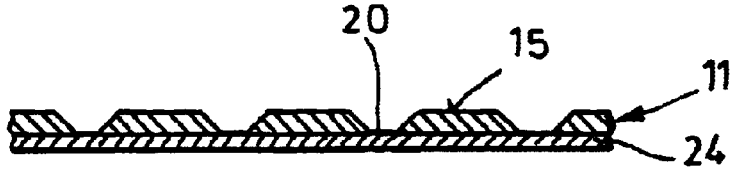
FIGS. 7–9 are longitudinal sections through respectively one conducting structure, arranged on a substrate, with differently shaped, connected regions, wherein each region has different metal thicknesses.
Figure 8:
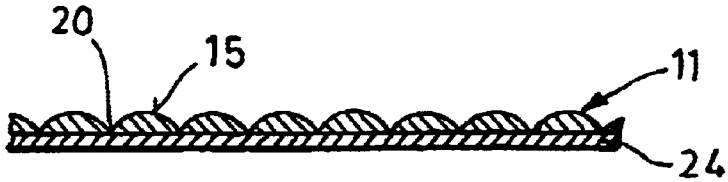
Figure 9:
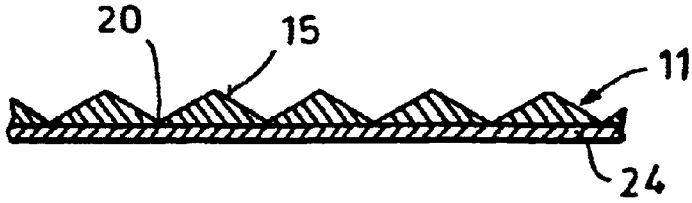

The decoupling resistances of another exemplary embodiment of the invention are shaped such that the layer thickness in the various regions of the respective rhombus, rectangle, circle or oval differs. The different metal thicknesses also define the characteristics of the decoupling resistances and can additionally be used to adjust specific resistance values of the lattice structure. Respective exemplary embodiments are shown in FIGS. 7–9. For this, the substrate (plastic carrier foil) is given the reference 24, the electrically conducting layer the reference 11, the region defining the respective resistance (e.g., rhombus-shaped region) is given the reference 15 and the respective connecting bridge is given the reference 20.

The invention now being fully described, it will be apparent to one of ordinary skill in the art that many changes and modifications can be made thereto without departing from the spirit or scope of the invention as set forth herein.

What is claimed is:

1. A cartridge comprising:

a combustible case containing a charge and an electrothermal ignition device including a plurality of ignition channels provided in the charge, and extending axial symmetrical in the direction of a longitudinal axis of the cartridge, and with each ignition channel comprising at least a first propellant tube that is provided on at least one of an inner and an outer surface with an electrically conducting layer that extends in the direction of the longitudinal axis of cartridge, and that is connected at its opposite ends to a respective electrode for connecting each of the electrically conducting layers across a power supply; and wherein each electrically conducting layer has a structure that forms at least one series connection of a plurality of electrical decoupling resistances interconnected by high resistance bridging elements, and each of the decoupling resistances has a geometrical shape and makes a point contact, as a bridging element, with adjacent resistances in a respective series connection, whereby following the activation of a power-supply system connected across the electrodes, current flowing through the structure causes several electric arcs to form between adjacent decoupling resistances as a result of local overheating in the bridging elements.

2. A cartridge according to claim 1, wherein the decoupling resistances are formed by at least one of rhombus-shaped, rectangular, circular and oval regions of the electrically conducting layer.

3. A cartridge according to claim 1, wherein the electrically conducting layer consists of aluminum or copper.

4. A cartridge according to claim 1, wherein a plastic foil is arranged on at least one of the inner and outer surfaces of the first propellant tube, and the electrically conducting layer is vapor deposited onto the plastic foil.

5. A cartridge according to claim 1, wherein each ignition channel includes at least three series connections of decoupling resistances that are connected in parallel.

6. A cartridge according to claim 1, wherein at least three axial symmetrical ignition channels are arranged in the charge.

7. A cartridge according to claim 5, wherein the length of the ignition channels is 50 to 400 mm.

8. A cartridge according to claim 7, wherein the length of the ignition channels is 200 to 300 mm.

9. A cartridge according to claim 1, wherein at least one said electrically conducting layer that extends in the direction of the longitudinal axis is arranged on the inside surface of the first propellant tube, and this one layer is directly followed on the inside by a second propellant tube or powder rod.

10. A cartridge according to claim 2, wherein the rhombus-shaped, rectangular, circular or oval regions of the electrically conducting layer have at least one of respectively differing thicknesses and shapes.

* * * * *